US011719240B2

(12) United States Patent
Eisele et al.

(10) Patent No.: US 11,719,240 B2
(45) Date of Patent: Aug. 8, 2023

(54) REDUCED-NOISE ROTARY PUMP

(71) Applicant: Schwäbische Hüttenwerke Automotive GmbH, Aalen-Wasseralfingen (DE)

(72) Inventors: Fabian Eisele, Herbertingen (DE); Thomas Wahl, Ertingen (DE); Sven Peters, Bad Schussenried (DE); Gerd Jäggle, Ertingen (DE); Igor Pekrul, Aulendorf (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 17/202,744

(22) Filed: Mar. 16, 2021

(65) Prior Publication Data

US 2021/0293238 A1 Sep. 23, 2021

(30) Foreign Application Priority Data

Mar. 18, 2020 (DE) ..... 102020107485.9

(51) Int. Cl.
*F03C 2/00* (2006.01)
*F03C 4/00* (2006.01)
(Continued)

(52) U.S. Cl.
CPC ..... *F04C 2/3442* (2013.01); *F04C 2/332* (2013.01); *F04C 2/3448* (2013.01); *F04C 14/226* (2013.01); *F04C 15/0049* (2013.01)

(58) Field of Classification Search
CPC ..... F04C 2/332; F04C 2/3442; F04C 2/3447; F04C 2/3448; F04C 14/226; F04C 14/28;
(Continued)

(56) References Cited

U.S. PATENT DOCUMENTS 2,397,098 A * 3/1946 Fowler ..... F04C 2/3441 418/150
4,616,984 A * 10/1986 Inagaki ..... F04C 18/3441 418/150
(Continued)

FOREIGN PATENT DOCUMENTS

CN 1421610 A 6/2003
DE 706484 C 5/1941
(Continued)

OTHER PUBLICATIONS

German Search Report issued in German Patent Application No. 10 2020 107 485.9 dated Jan. 27, 2021. 7 pages.
(Continued)

*Primary Examiner* — Theresa Trieu
(74) *Attorney, Agent, or Firm* — RatnerPrestia

(57) ABSTRACT

A rotary pump, preferably a vane cell pump or a pendulum slider pump, includes a stator and a rotor which rotates about a rotational axis within the stator. The rotor includes multiple delivery elements which move radially in relation to the rotational axis, and two adjacent delivery elements limit a delivery cell together with the outer surface area of the rotor and the inner surface area of the stator. At least two delivery cells, preferably two adjacent delivery cells, exhibiting a first maximum cell volume form a first delivery cell group and at least two other delivery cells, preferably two other adjacent delivery cells, exhibiting a second maximum cell volume form a second delivery cell group. The first maximum cell volume of the delivery cells of the first delivery cell group is larger than the second maximum cell volume of the delivery cells of the second delivery cell group.

22 Claims, 5 Drawing Sheets

(51) Int. Cl.

| | |
|---|---|
| ***F04C 18/00*** | (2006.01) |
| ***F04C 2/00*** | (2006.01) |
| ***F04C 2/344*** | (2006.01) |
| ***F04C 2/332*** | (2006.01) |
| ***F04C 14/22*** | (2006.01) |
| ***F04C 15/00*** | (2006.01) |

(58) Field of Classification Search
CPC .. F04C 15/00; F04C 15/0049; F04C 15/0088; F04C 2270/13
See application file for complete search history.

(56) References Cited

U.S. PATENT DOCUMENTS

| | | | | |
|---|---|---|---|---|
| 4,737,090 | A * | 4/1988 | Sakai | F04C 18/3441 418/150 |
| 6,227,832 | B1 * | 5/2001 | Rechberger | F04C 18/3441 418/150 |
| 2002/0081210 | A1 | 6/2002 | Aden et al. | |
| 2003/0124014 | A1 | 7/2003 | Takatsu | |
| 2012/0082582 | A1 * | 4/2012 | Richter | F04C 2/332 418/268 |

FOREIGN PATENT DOCUMENTS

| | | | |
|---|---|---|---|
| DE | 2415620 | A | 11/1974 |
| DE | 102009040647 | A1 | 4/2011 |
| DE | 10 2011 078 038 | A1 | 12/2012 |
| EP | 0875677 | A1 | 11/1998 |
| FR | 773258 | A | 11/1934 |
| JP | 5016106 | A | 2/1975 |
| WO | 2012007125 | A2 | 1/2012 |
| WO | 2012175348 | A2 | 12/2012 |

OTHER PUBLICATIONS

Chinese Office Action with Search Report for Chinese Application No. 202110285681.0, dated Sep. 14, 2022, with translation, 26 pages.

* cited by examiner

REDUCED-NOISE ROTARY PUMP

CROSS REFERENCE TO RELATED APPLICATION

This application claims benefit of priority from German Patent Application No. 10 2020 107 485.9, filed Mar. 18, 2020. The contents of this application are incorporated herein by reference.

FIELD OF THE INVENTION

The invention relates to a rotary pump for delivering a delivery medium. The rotary pump comprises a stator and a rotor which can rotate about a rotational axis within the stator. The rotor comprises multiple delivery elements which are distributed over the circumference of the rotor. The delivery elements are arranged on the rotor such that they can move radially in relation to the rotational axis. Each two adjacent delivery elements limit a delivery cell together with the outer surface area of the rotor, the inner surface area of the stator and axial walls (the base and cover), such that the rotary pump comprises multiple delivery cells, wherein at least two delivery cells which exhibit a first maximum cell volume form a first delivery cell group. At least two other delivery cells, which exhibit a second maximum cell volume, form a second delivery cell group.

BACKGROUND OF THE INVENTION

DE 2 415 620 A1, incorporated herein by reference, discloses a device on hydraulic pumps and displacement-type motors, in which the pump rotor is embodied with a non-uniform pitch between the individual pump bodies such as pistons or vanes. The varying geometrical distances between all the pump bodies mean that the pulses of the delivery medium delivered by the pump are consecutive as far as possible in an irregular order and accordingly the total noise level is reduced to a minimum without any form of insulation or shielding.

DE 706 484 A1, incorporated herein by reference, discloses a rotary piston drive or work machine having a sickle-shaped working space. The machine comprises a housing in which an eccentric rotor is mounted which comprises slots for sliders. In order to avoid exciting the rotor, the distances between the slot openings on the rotor circumference, as measured in radians, differ in size. Furthermore, the angle between the radius and the center line of the slider is different for different sliders.

FR 773 258 A1, incorporated herein by reference, also discloses a rotary piston machine, the paddles of which are attached to a piston drum such that they can move within a sickle-shaped working chamber, wherein the distances separating the paddles from each other differ in size.

SUMMARY OF THE INVENTION

An aspect of the present invention is a rotary pump which emits less noise during operation.

The rotary pump in accordance with an aspect of the invention, which is preferably embodied as a vane cell pump or pendulum slider pump, comprises a stator and a rotor. The rotor is arranged such that it can rotate about a rotational axis within the stator. Furthermore, the rotor comprises a plurality of delivery elements which can move radially in relation to the rotational axis. Each two adjacent delivery elements limit a delivery cell together with the outer surface area of the rotor and the inner surface area of the stator, such that the rotary pump comprises a multitude of delivery cells. At least two delivery cells which exhibit a first maximum cell volume form a first delivery cell group. The delivery cells of the first delivery cell group are preferably adjacent delivery cells. At least a second delivery cell group is formed by at least two other delivery cells which exhibit a second maximum cell volume. The delivery cells of the second delivery cell group are preferably adjacent delivery cells. The rotary pump preferably comprises only grouped delivery cells. The rotary pump advantageously lacks delivery cells which are not assigned to one of the delivery cell groups. In other words, the rotary pump preferably comprises only delivery cells which are assigned to a delivery cell group. The rotary pump can comprise delivery cells which are grouped into exactly two delivery cell groups, into exactly three delivery cells, into exact four delivery cell groups, etc.

In accordance with an aspect of the invention, the first maximum cell volume of the delivery cells of the first delivery cell group differs from the second maximum cell volume of the delivery cells of the second delivery cell group in that it is larger, advantageously at least 10% larger, particularly advantageously at least 15% larger and most particularly advantageously at least 20% larger. Grouping the delivery cells into delivery cell groups in this way advantageously means that the acoustic emissions of the rotary pump during operation can be significantly reduced.

Embodying the delivery cells in accordance with an aspect of the invention and grouping them into delivery cell groups in particular influences the pressure pulses of a delivery medium which is delivered by the rotary pump, in such a way that the excitation vibrations resulting from the pressure pulses are reduced. This in turn minimizes the noise emitted by the rotary pump.

The term "adjacent" is to be understood in such a way as to denote similar elements of the rotary pump which are immediately next to each other in the circumferential direction of the rotor. The term "adjacent delivery cells", for example, denotes delivery cells which are immediately next to each other in the circumferential direction of the rotor. The term "adjacent delivery elements" denotes delivery elements which are immediately next to each other in the circumferential direction of the rotor.

The stator preferably comprises a cylindrical hollow space in which the rotatable rotor is arranged. The maximum outer diameter of the rotor is advantageously smaller than the minimum inner diameter of the cylindrical hollow space of the stator. The cylindrical hollow space of the stator can exhibit a circular cross-section or an elliptical cross-section or another type of cross-section.

The radial movement of the delivery elements relates in a technically expedient way to the rotational axis of the rotor. The radial movement of the delivery elements towards the rotational axis is preferably limited by the structure of the rotor and/or a supporting means, for example a supporting ring. The radial movement of the delivery elements away from the rotational axis can be limited by the inner surface area of the stator and/or by a supporting means of the stator. The delivery elements can for example be moved radially outwards when the rotor is rotating due to the centrifugal force acting on the delivery elements, wherein this movement is limited by the inner surface area of the stator.

Each delivery cell exhibits a cell volume which can be filled by the delivery medium to be delivered when the rotary pump is in operation, in particular when the rotor is rotating about the rotational axis. The cell volume of each delivery cell advantageously changes when the rotor rotates about its rotational axis. In a rotary pump which is embodied as a multi-flow rotary pump, the cell volume can for example change multiple times, in particular periodically, from a maximum cell volume to a minimum cell volume to a maximum cell volume as the rotor rotates through 360°. In a mono-flow rotary pump, the cell volume of the delivery cells will for example change only once from a maximum cell volume to a minimum cell volume to a maximum cell volume as the rotor rotates through 360°.

As already mentioned, there is at least one rotational angular position of the rotor at which the delivery cells exhibit a maximum cell volume. Alternatively or additionally, the delivery cells can also exhibit the maximum cell volume over a rotational angular position range of the rotor. This is advantageously the rotational angular position and/or rotational angular range of the rotor at which the conveyor cells pass through a circumferential position at which the distance between the outer surface area of the rotor and the inner surface area of the stator is at a maximum.

In order to deliver fluid, the delivery cells increase in size up to the maximum cell volume as the rotor rotates and then decrease in size again. Per complete revolution of the rotor For each complete revolution of the rotor, the delivery cells exhibit a cell volume which is a maximum cell volume for the respective delivery cell, i.e. a cell-specific maximum cell volume. In the course of a 360° revolution of the rotor, the respective delivery cell reaches but does not exceed its maximum cell volume. There is no rotational angular position of the rotor in which the respective delivery cell exhibits a cell volume which is larger than its maximum cell volume.

In first embodiments, in particular embodiments in which the rotary pump comprises only one working flow, i.e. in which the rotary pump is a mono-flow rotary pump, the rotary pump can be embodied such that each of the delivery cells only reaches its cell-specific maximum cell volume once during a complete revolution of the rotor. If the pump is a multi-flow pump, it can be embodied in second embodiments such that each of the delivery cells reaches its cell-specific maximum cell volume multiple times during a complete revolution of the rotor, for example if the working flows of the pump have the same stroke. If the pump is a multi-flow pump, it can however instead also be embodied in third embodiments such that each of the delivery cells only reaches its cell-specific maximum cell volume once during a complete rotation of the rotor, for example if the working flows of the pump have different strokes.

The delivery cells of the first delivery cell group preferably exhibit an at least substantially identical first maximum cell volume, wherein the shape of the delivery cells of the first delivery cell group can be different and/or identical. The delivery cells of the second delivery cell group preferably exhibit an at least substantially identical second maximum cell volume, irrespective of the embodiment of the delivery cells of the first cell group, wherein the shape of the delivery cells of the second delivery cell group can be different and/or identical. An "at least substantially identical maximum cell volume" is in particular to be understood to mean that two cell volumes can differ from each other by 10% at most, advantageously 5% at most and particularly advantageously only due to manufacturing tolerances.

In one advantageous development, the delivery elements which limit a delivery cell of the first delivery cell group are each arranged at a first angular distance from each other on the rotor. The delivery elements which limit a delivery cell of the second delivery cell group can each be arranged at a second angular distance from each other on the rotor, wherein the angular distances are defined in such a way that they describe the angle which is enclosed by two straight lines, wherein the straight lines each connect a reference point of two adjacent delivery elements on the rotor to the apex of the angle on the rotational axis of the rotor.

The first angular distance between each two delivery elements of the first delivery cell group is preferably at least substantially identical, and the second angular distance between each two delivery elements of the second delivery cell group is at least substantially identical, wherein the first angular distance differs from the second angular distance. An "at least substantially identical angular distance" is in particular to be understood to mean that two angular distances can differ from each other by 1° at most, advantageously 0.5° at most and particularly advantageously only due to manufacturing tolerances. The first angular distance is advantageously larger, advantageously at least 1° larger, particularly advantageously at least 3° larger and most particularly advantageously at least 5° larger, than the second angular distance. The first angular distance can for example measure between 40° and 45°, preferably 43°. The second angular distance can for example measure 35 to 40°, preferably 38.5°.

In another embodiment of the rotary pump, the number of delivery cells in the first delivery cell group is not equal to the number of delivery cells in the second delivery cell group. In general, the number of delivery cells in each delivery cell group can be varied as desired, as long as each delivery cell group comprises at least two delivery cells. The number of delivery cells in the first delivery cell group is preferably smaller than the number of delivery cells in the second delivery cell group. The first delivery cell group can for example comprise three delivery cells, while the second delivery cell group comprises six delivery cells. In this example embodiment, the rotary pump comprises a total of nine delivery cells.

In a further development, the circumferential distance along the inner surface area of the stator between two adjacent delivery elements which limit a delivery cell of the first delivery cell group is larger than the circumferential distance along the inner surface area of the stator between two adjacent delivery elements which limit a delivery cell of the second delivery cell group. In this further development, all the delivery elements can for example be arranged at a constant angular distance from each other on the rotor, without radially protruding perpendicularly out of the rotor. The delivery elements can instead be radially arranged obliquely on the rotor.

Advantageously, the circumferential distance along the outer surface area of the rotor between two adjacent delivery elements which limit a delivery cell of the first delivery cell group is larger than the circumferential distance along the outer surface area of the rotor between two adjacent delivery elements which limit a delivery cell of the second delivery cell group. In rotary pumps in which the circumferential distance along the inner surface area of the stator between all the delivery elements is constant, the first maximum cell volume of the delivery cells of the first delivery cell group can then for example be embodied to be larger than the second maximum cell volume of the delivery cells of the second delivery cell group. In this embodiment, the delivery elements are preferably radially arranged obliquely on the rotor.

In possible developments, the rotary pump can comprise more than two delivery cell groups, wherein the maximum cell volume of the delivery cells of each delivery cell group is advantageously not equal to the maximum cell volumes of the delivery cells of each of the other delivery cell groups.

A rotary pump can for example comprise three delivery cell groups, wherein the delivery cells of the first delivery cell group exhibit a first maximum cell volume, the delivery cells of the second delivery cell group exhibit a second maximum cell volume, and the delivery cells of the third delivery cell group exhibit a third maximum cell volume. The first maximum cell volume is advantageously larger than the second maximum cell volume, and the second maximum cell volume is advantageously larger than the third maximum cell volume.

Alternatively or additionally, in an embodiment in which the rotary pump comprises more than three delivery cell groups, the maximum cell volumes of the delivery cells of non-adjacent delivery cell groups can be identical. An embodiment of the rotary pump comprising six delivery cell groups can for example be embodied in such a way that two non-adjacent delivery cell groups comprise delivery cells which exhibit an identical maximum cell volume.

In a preferred embodiment of the rotary pump, the rotor is arranged eccentrically in relation to the stator. In other words, the stator—in particular, the cylindrical hollow space in which the rotor is arranged—can exhibit a center axis. If arranged eccentrically, the center axis of the stator is spaced from the rotational axis of the rotor. This means that the distance between the outer surface area of the rotor and the inner surface area of the stator varies and/or is not constant over the circumference of the rotor. This eccentricity is for example advantageous in mono-flow rotary pumps.

In a further development, the eccentricity between the stator and the rotor is variable. The position of the stator relative to the rotor can for example be variable in such a way that the distance between the center axis of the stator and the rotational axis of the rotor is variable. A variable eccentricity between the stator and the rotor advantageously means that the delivery rate of the rotary pump during operation, in particular when the rotor is rotating, can be controlled. The rotary pump can for example exhibit a maximum delivery rate at a maximum eccentricity, in particular a maximum distance between the center axis of the stator and the rotational axis of the rotor, and a minimum delivery rate at a minimum eccentricity, in particular a minimum distance between the center axis of the stator and the rotational axis of the rotor.

The region in which the distance between the outer surface area of the rotor and the inner surface area of the stator in the rotational direction of the rotor increases advantageously forms a suction region of the rotary pump. The suction region begins for example at the circumferential position of the stator at which the distance between the outer surface area of the rotor and the inner surface area of the stator is at its smallest. The delivery cells advantageously have a minimum cell volume when they are caused to reach the beginning of the suction region by rotating the rotor. The suction region can end at the circumferential position of the stator at which the distance between the outer surface area of the rotor and the inner surface area of the stator is at its largest. The delivery cells advantageously have a maximum cell volume when they are caused to reach the end of the suction region by rotating the rotor. The suction region of the rotary pump is preferably connected to a suction port via which the delivery medium can be provided.

The region in which the distance between the outer surface area of the rotor and the inner surface area of the stator in the rotational direction of the rotor decreases can form a pressure region of the rotary pump. The pressure region begins for example at the circumferential position of the stator at which the distance between the outer surface area of the rotor and the inner surface area of the stator is at its largest. The delivery cells advantageously have a maximum cell volume when they are caused to reach the beginning of the pressure region by rotating the rotor. The pressure region can end at the circumferential position of the stator at which the distance between the outer surface area of the rotor and the inner surface area of the stator is at its smallest. The delivery cells advantageously have a minimum cell volume when they are caused to reach the end of the pressure region by rotating the rotor. The pressure region of the rotary pump is preferably connected to a pressure port via which the delivery medium can be discharged.

In a developing embodiment, the rotary pump can comprise a stator which exhibits a cylindrical hollow space having an elliptical cross-section, such that the rotary pump can deliver the delivery medium in multiple flows. The term "multiple flows" means that the rotary pump comprises multiple suction regions and pressure regions.

In a rotary pump which is embodied as a vane cell pump, the delivery elements are embodied as vanes. In a rotary pump which is embodied as a pendulum slider pump, the delivery elements are embodied as *pendula* which are arranged on the rotor, preferably such that they can pivot, in particular in the circumferential direction in relation to the outer surface area of the rotor. In this embodiment, the stator is advantageously embodied as a rotatable outer rotor which is connected to the *pendula* in such a way that the rotational movement of the rotor can be transmitted onto the outer rotor via the *pendula*.

The rotary pump is in particular designed for use in a motor vehicle. The rotary pump can accordingly be embodied as a motor vehicle pump. The rotary pump is preferably designed to deliver a liquid, in particular a lubricant, coolant and/or actuating agent. The rotary pump can accordingly be embodied as a liquid pump. The rotary pump is preferably designed to supply, lubricate and/or cool a motor vehicle drive motor or a motor vehicle transmission. The liquid is preferably embodied as an oil, in particular an engine lubricating oil or transmission oil. The rotary pump can be embodied as an engine lubricant pump for a motor vehicle or as a transmission pump for a motor vehicle.

BRIEF DESCRIPTION OF THE DRAWINGS

Different example features of aspects of the invention can be combined in accordance with the invention, wherever technically expediently and suitable. Other features and advantages of aspects of the invention follow from the following description of example embodiments on the basis of the figures. The figures show.

DETAILED DESCRIPTION OF THE INVENTION

Figure 1:
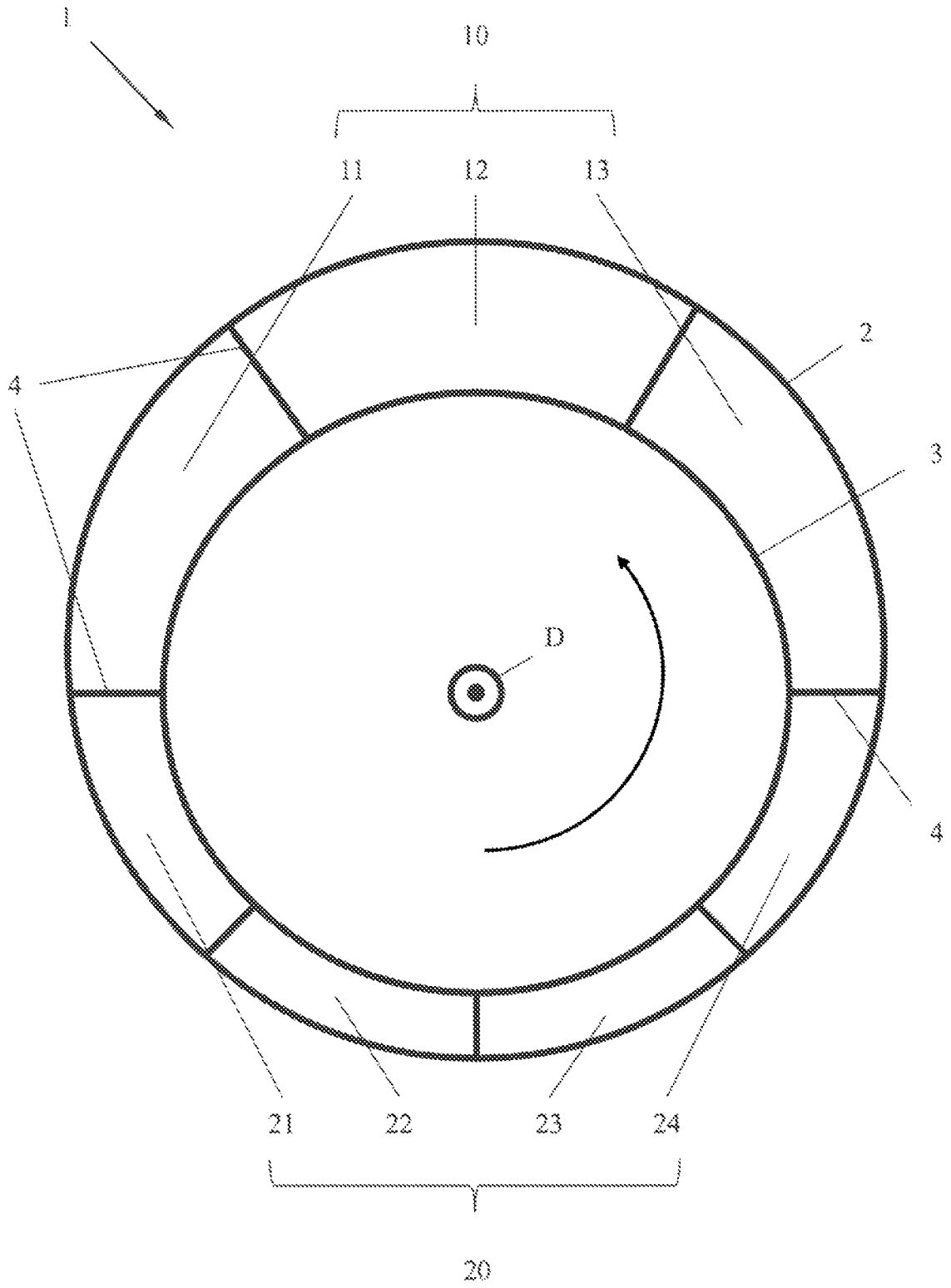
FIG. 1 a schematic sectional representation of a first example embodiment of the rotary pump in accordance with the invention.

FIG. 1 shows a schematic sectional representation of a first example embodiment of the rotary pump 1. In the first example embodiment, the rotary pump 1 is embodied as a vane cell pump 1 which comprises a stator 2 featuring a circular-cylindrical hollow space.

A rotor 3 which can rotate about a rotational axis D is arranged within the circular-cylindrical hollow space of the stator 2. The outer diameter of the rotor 3 is smaller than the inner diameter of the circular-cylindrical hollow space of the stator 2, such that the outer surface area of the rotor 3 is spaced from the inner surface area of the stator 2. The rotational axis D preferably also forms the center axis of the rotor 3. In the example embodiment shown, the rotor 3 is arranged eccentrically with respect to the stator 2.

As shown in FIG. 1, the rotor 3 comprises multiple delivery elements 4 which are distributed over the circumference of the rotor 3. The delivery elements 4 project radially from the rotor 3 in relation to the rotational axis D and are attached to or arranged on the rotor 3 such that they can move in a radial direction. A radial movement of the delivery elements 4, pointing outwards away from the rotational axis D, is limited by the inner surface area of the stator 2.

Together with the inner surface area of the stator 2 and the outer surface area of the rotor 3, each two adjacent delivery elements 4 limit a delivery cell 11 to 13, 21 to 24. The example embodiment shown in FIG. 1 comprises a total of seven delivery cells 11 to 13, 21 to 24. Due to the eccentricity of the rotor 3 relative to the stator 2, each delivery cell 11 to 13, 21 to 24 exhibits a maximum cell volume. In the vane cell pump 1 depicted in FIG. 1, for example, each delivery cell 11 to 13, 21 to 24 reaches its maximum cell volume when it is in the "12 o'clock" position, due to the rotational movement of the rotor 3. Consequently, when the vane cell pump 1 is in the state depicted in FIG. 1, the delivery cell 12 has reached its maximum cell volume.

The three adjacent delivery cells 11 to 13 exhibit an identical first maximum cell volume at the "12 o'clock" position and together form a first delivery cell group 10. The four adjacent delivery cells 21 to 24 exhibit an identical second maximum cell volume at the "12 o'clock" position and together form a second delivery cell group 20. The first maximum cell volume of the delivery cells 11 to 13 is larger than the second maximum cell volume of the delivery cells 21 to 24.

The region between the outer surface area of the rotor 3 and the inner surface area of the stator 2 on the right-hand side half of the vane cell pump 1 depicted in FIG. 1 forms a suction region when the rotor 3 rotates anti-clockwise. Within the suction region, the cell volumes of the delivery cells 11 to 13, 21 to 24 increase in size from a minimum cell volume at the "6 o'clock" position to the maximum cell volume at the "12 o'clock" position. In advantageous embodiments of the vane cell pump 1, the suction region is connected to a suction port (not shown) for the delivery medium, such that the delivery medium is suctioned via the suction port by the increase in the delivery volumes of the individual delivery cell 11 to 13, 21 to 24.

The region between the outer surface area of the rotor 3 and the inner surface area of the stator 2 on the left-hand side half of the vane cell pump 1 depicted in FIG. 1 forms a pressure region when the rotor 3 rotates anti-clockwise. Within the pressure region, the cell volumes of the delivery cells 11 to 13, 21 to 24 decrease in size from a maximum cell volume at the "12 o'clock" position to the minimum cell volume at the "6 o'clock" position. In advantageous embodiments of the vane cell pump 1, the pressure region is connected to a pressure port (pressure outlet, not shown) for the delivery medium, such that the delivery medium is pumped away via the pressure port (pressure outlet) by the decrease in the delivery volumes of the individual delivery cell 11 to 13, 21 to 24.

Because the delivery cells 11 to 13, 21 to 24 are advantageously embodied and grouped into two delivery cell groups, the pressure pulses of the delivery medium at the pressure port (pressure outlet) are influenced in such a way that the excitation vibrations resulting from the pressure pulses are reduced. This in turn minimizes the noise emitted by the vane cell pump 1.

Figure 2:
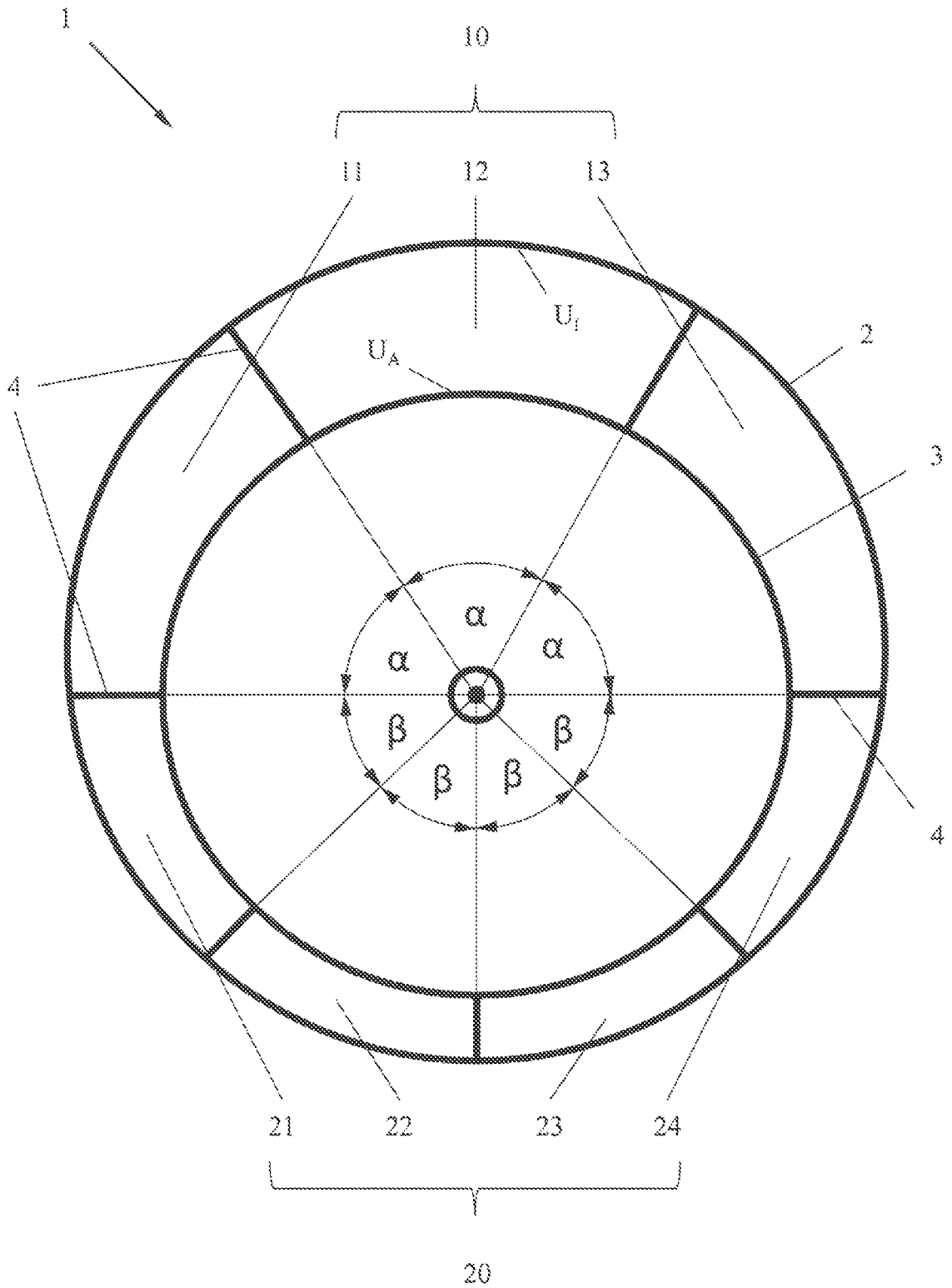
FIG. 2 a second schematic sectional representation of the first example embodiment of the rotary pump in accordance with the invention.

FIG. 2 shows another schematic sectional representation of the first example embodiment of the rotary pump 1, wherein the angular distances α, β of the individual delivery elements 4 from each other are indicated. The delivery elements 4 which limit the delivery cells 11 to 13 of the first delivery cell group 10 are arranged at a first angular distance α from each other on the rotor 3. The delivery elements 4 which limit the delivery cells 21 to 24 of the second delivery cell group 20 are arranged at a second angular distance β from each other on the rotor 3, wherein the first angular distance α is larger than the second angular distance β. This means that the respective first maximum cell volume of the delivery cells 11 to 13 of the first delivery cell group 10 is larger than the respective second maximum cell volume of the delivery cells 21 to 24 of the second delivery cell group 20.

FIG. 2 also shows a circumferential distance $U_I$ which extends between two adjacent delivery elements 4 along the inner surface area of the stator 2. A circumferential distance $U_A$ extends between two adjacent delivery elements 4 along the outer surface area of the rotor 3. In the example embodiment of the rotary pump 1 shown in FIG. 2, both the circumferential distance $U_I$ and the circumferential distance $U_A$ between the delivery cells 11 to 13 of the first delivery cell group 10 is larger than the circumferential distances $U_I$, $U_A$ between the delivery cells 21 to 24 of the second delivery cell group 20. In particular in an embodiment of the rotary pump 1 (not shown) in which the delivery elements 4 are arranged at a constant angular distance on the rotor 3 but do not perpendicularly project radially outwards from the outer surface area of the rotor 3, the maximum cell volume of the delivery cells 11 to 13 of the first delivery cell group 10 can differ in relation to the maximum cell volume of the delivery cells 21 to 24 of the second delivery cell group 20 due to a different circumferential distance $U_I$ and/or a different circumferential distance $U_A$.

Figure 3:
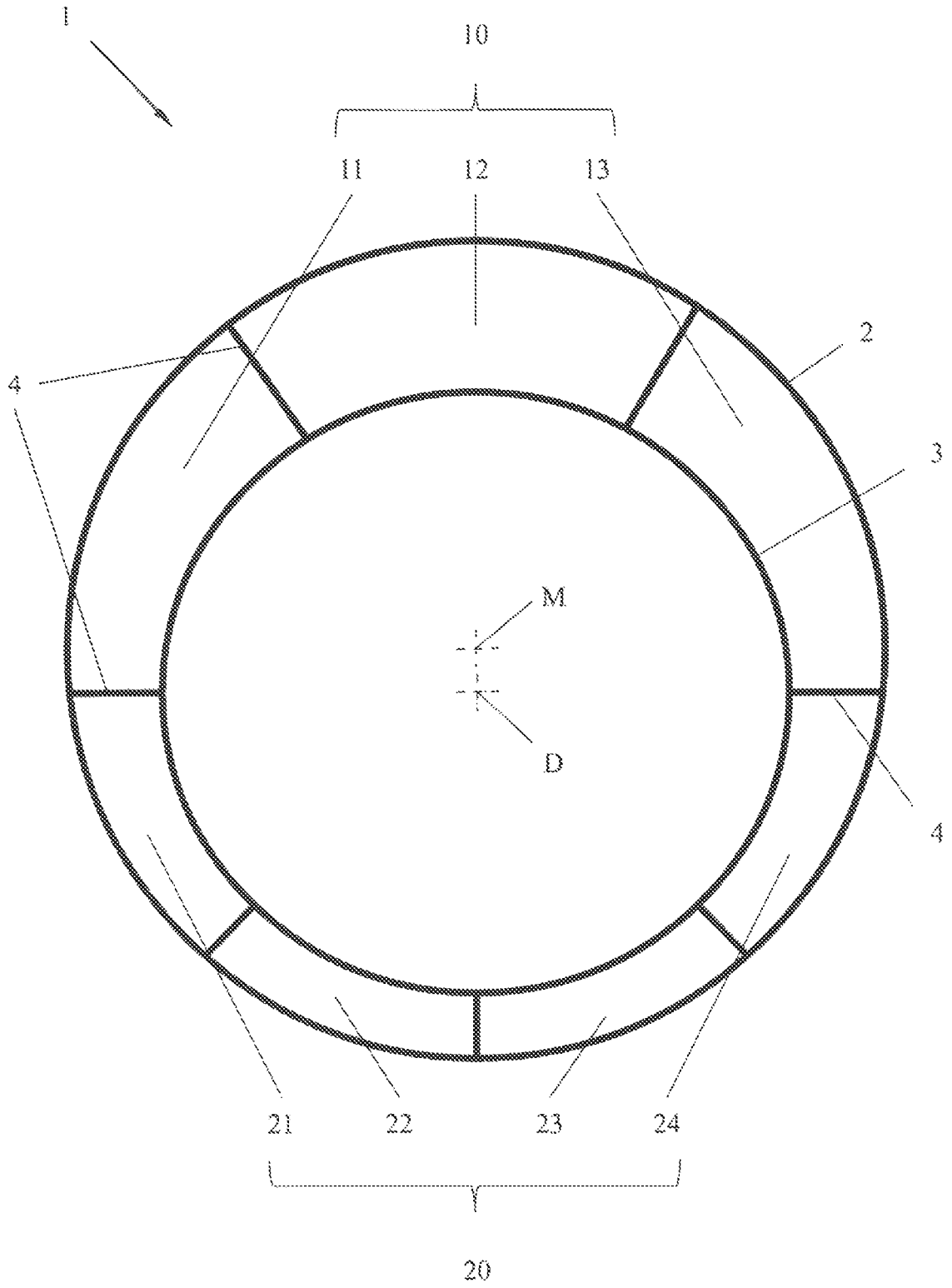
FIG. 3 a third schematic sectional representation of the first example embodiment of the rotary pump in accordance with the invention.

FIG. 3 shows the example embodiment of the rotary pump 1 depicted in FIG. 1, wherein the rotational axis D of the rotor 2 and the center axis M of the stator 2 are shown. The rotational axis D is offset from the center axis M, such that the rotor 3 is arranged eccentrically with respect to the stator 2. This eccentricity means that when the rotor 3 rotates anti-clockwise, the region between the outer surface area of the rotor 3 and the inner surface area of the stator 2 on the right-hand side half of the rotary pump 1 forms a suction region. Conversely, the region between the outer surface area of the rotor 3 and the inner surface area of the stator 2 on the left-hand side half of the rotary pump 1 forms a pressure region.

In a development of the example embodiment of the rotary pump 1 shown in FIG. 3, the eccentricity of the rotor 3 relative to the stator 2 can be embodied to be variable. The position of the stator 2 relative to the rotor 3 could for example be varied in such a way that the center axis M coincides with the rotational axis D in a second position of the stator 2. As a result, the distance between the outer surface area of the rotor 3 and the inner surface area of the stator 2 remains constant over the entire circumference. When in operation, the rotary pump 1 would exhibit a so-called zero throughput in the second position of the stator 2, in which the delivery rate of the rotary pump 1 would be significantly reduced or eliminated. Ultimately, the delivery rate of the rotary pump can be controlled via the eccentricity of the stator 2 relative to the rotor 3.

Figure 4:
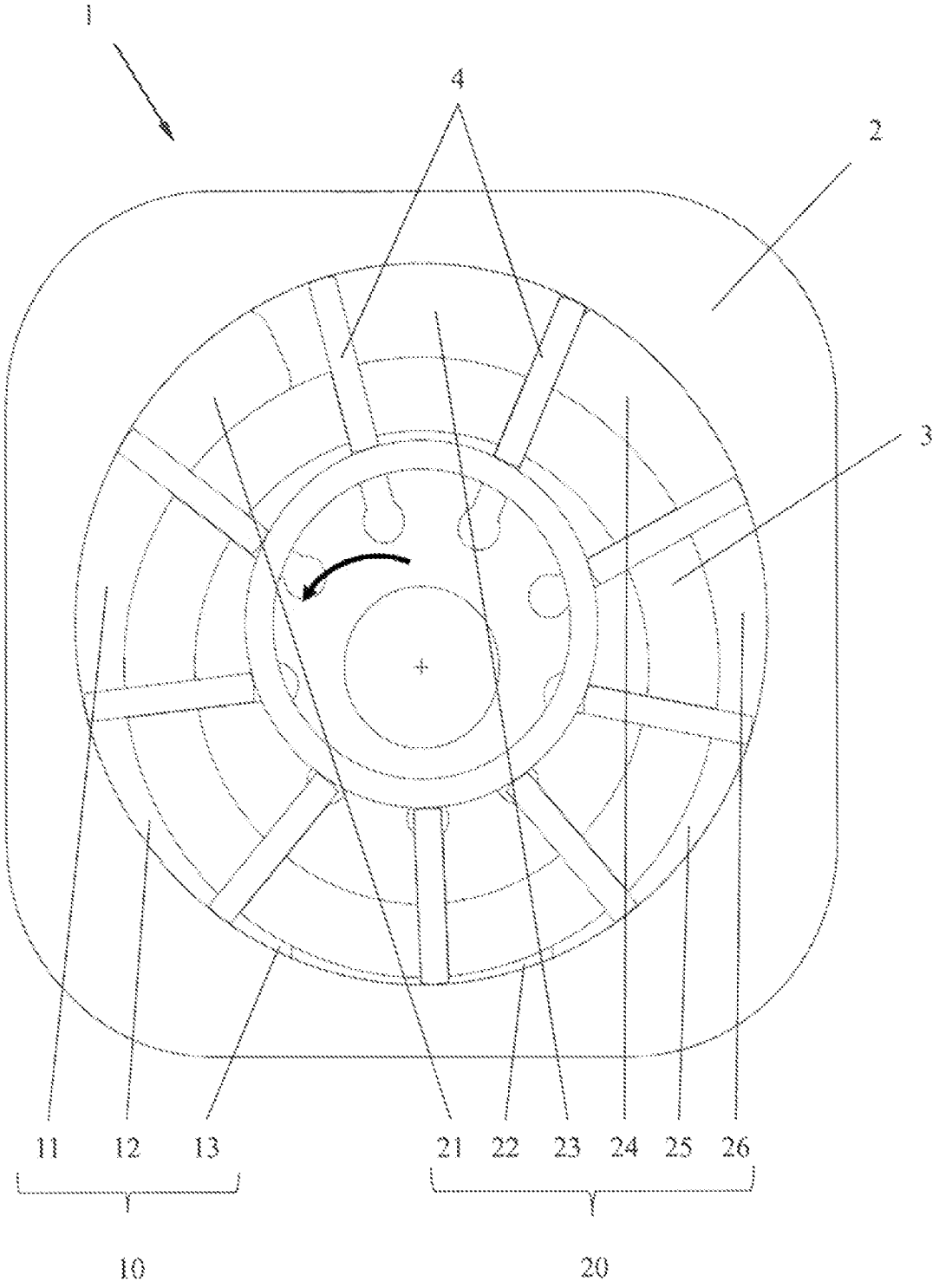
FIG. 4 a sectional representation of a second example embodiment of the rotary pump in accordance with the invention.

FIG. 4 shows a sectional representation of a second example embodiment of a rotary pump 1. In the second example embodiment, the rotary pump 1 is again embodied as a vane cell pump 1. In the second example embodiment, the vane cell pump 1 comprises a total of nine delivery cells 11 to 13, 21 to 26. The first delivery cell group 10 is formed by the adjacent delivery cells 11 to 13, wherein the adjacent delivery cells 11 to 13 are limited by delivery elements 4 which are arranged at a first angular distance α (not shown) of 43° from each other on the rotor 3. The second delivery cell group 20 is formed by the adjacent delivery cells 21 to 26, wherein the adjacent delivery cells 21 to 26 are limited by delivery elements 4 which are arranged at a second angular distance β (not shown) of 38.5° from each other on the rotor 3.

Figure 5:
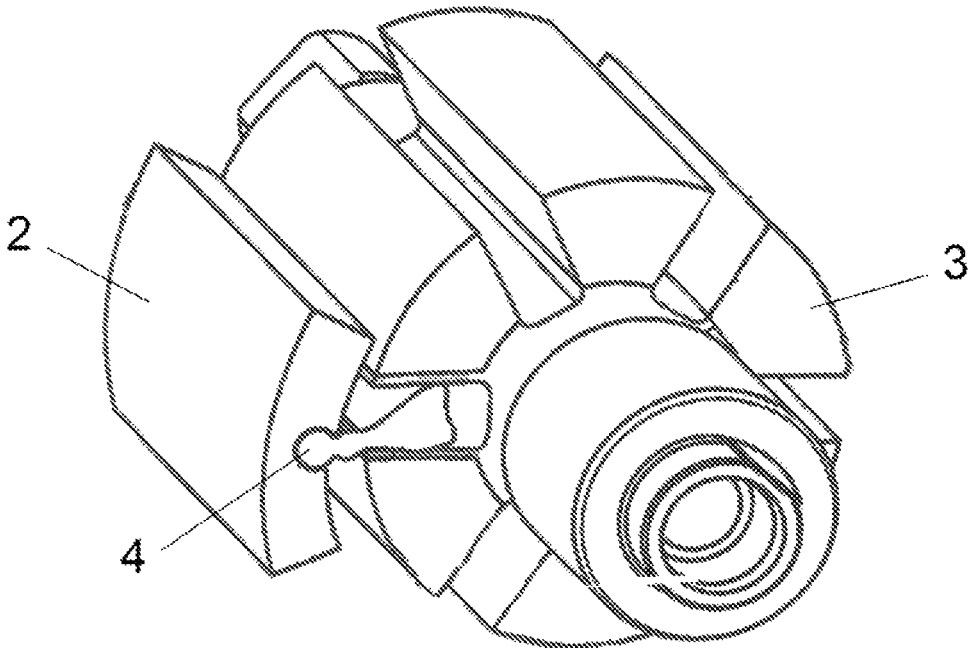
Fig. 5 (Prior Art)
FIG. 5 illustrates a conventional pendulum slider pump.

FIG. 5 illustrates a rotor 3 of a well-known pendulum slider pump and a part of the stator 2. A delivery element 4 serving as a pendulum, which is moveably fixed at the stator 2 and extends into a slot of the rotor 3. The rotor 3 comprises a plurality of slots and a plurality of lands between two adjacent slots. The pump comprises further delivery elements each moveably fixed at the stator 2 and extending in one of the slots of the rotor 3 like the delivery element 4 shown in the figure. The lands of the rotor 3 form an outer surface area of the rotor 3. The stator 2 comprises an inner surface area that surrounds the outer surface area of the rotor 3. Each two adjacent delivery elements 4 limit a delivery cell together with the outer surface area of the rotor 3 and the inner surface area of the stator 2.

LIST OF REFERENCE SIGNS

1 vane pump
2 stator
3 rotor
4 delivery elements
10 first delivery cell group
11 delivery cell
12 delivery cell
13 delivery cell
20 second delivery cell group
21 delivery cell
22 delivery cell
23 delivery cell
24 delivery cell
25 delivery cell
26 delivery cell
α first angular distance
β second angular distance
D rotational axis of the rotor
M center axis of the stator
$U_I$ circumferential distance along the inner surface area of the stator
$U_A$ circumferential distance along the outer surface area of the rotor

The invention claimed is:

1. A rotary pump comprising:
(a) a stator and
(b) a rotor rotatable about a rotational axis within the stator, wherein
(c) the rotor comprises multiple delivery elements adapted to move radially in relation to the rotational axis, and
(d) two adjacent delivery elements limit a delivery cell together with an outer surface area of the rotor and an inner surface area of the stator, wherein
(e) at least two delivery cells, which exhibit a first maximum cell volume form a first delivery cell group and
(f) at least two other delivery cells, which exhibit a second maximum cell volume form a second delivery cell group,
wherein
(g) the first maximum cell volume of the delivery cells of the first delivery cell group is larger than the second maximum cell volume of the delivery cells of the second delivery cell group, and
(h) wherein the delivery elements which limit a delivery cell of the first delivery cell group are each arranged at a first angular distance from each other on the rotor, and the delivery elements which limit a delivery cell of the second delivery cell group are each arranged at a second angular distance from each other on the rotor, wherein the first angular distance is larger than the second angular distance.

2. The rotary pump according to claim 1, wherein the delivery cells of the first delivery cell group exhibit an at least an identical first maximum cell volume, and the delivery cells of the second delivery cell group exhibit an identical second maximum cell volume.

3. The rotary pump according to claim 1, wherein a number of delivery cells in the first delivery cell group is not equal to a number of delivery cells in the second delivery cell group.

4. The rotary pump according to claim 1, wherein a number of delivery cells in the first delivery cell group is smaller than a number of delivery cells of the second delivery cell group.

5. The rotary pump according to claim 1, wherein the first delivery cell group comprises at least two and at most six delivery cells, wherein the adjacent delivery elements of the first delivery cell group are arranged at the first angular distance of 40° to 45° from each other on the rotor.

6. The rotary pump according to claim 1, wherein the second delivery cell group comprises at least four and at most ten delivery cells, wherein the adjacent delivery elements of the second delivery cell group are arranged at the second angular distance of 35° to 40° from each other on the rotor.

7. The rotary pump according to claim 1, wherein the rotary pump comprises a total of at least six and at most sixteen delivery cells.

8. The rotary pump according to claim 1, wherein a circumferential distance along the inner surface area of the stator between two adjacent delivery elements which limit a delivery cell of the first delivery cell group is larger than a circumferential distance along the inner surface area of the stator between two adjacent delivery elements which limit a delivery cell of the second delivery cell group.

9. The rotary pump according to claim 1, wherein a circumferential distance along the outer surface area of the rotor between two adjacent delivery elements which limit a delivery cell of the first delivery cell group is larger than a circumferential distance along the outer surface area of the rotor between two adjacent delivery elements which limit a delivery cell of the second delivery cell group.

10. The rotary pump according to claim 1, wherein the rotary pump comprises more than two delivery cell groups.

11. The rotary pump according to claim 10, wherein a maximum cell volume of the delivery cells of each delivery cell group is not equal to a maximum cell volumes of the delivery cells of each of the other delivery cell groups.

12. The rotary pump according to claim 10, wherein the delivery cells of two non-adjacent delivery cell groups exhibit an identical maximum cell volume.

13. The rotary pump according to claim 1, wherein the pump is a vane cell pump or a pendulum slider pump.

14. The rotary pump according to claim 1, wherein the at least two delivery cells which exhibit the first maximum cell volume and form the first delivery cell group are adjacent delivery cells or the at least two other delivery cells which exhibit the second maximum cell volume and form the second delivery cell group are adjacent delivery cells.

15. A rotary pump comprising:

(a) a stator and (b) a rotor rotatable about a rotational axis within the stator, wherein (c) the rotor comprises multiple delivery elements adapted to move radially in relation to the rotational axis, and (d) two adjacent delivery elements limit a delivery cell together with an outer surface area of the rotor and an inner surface area of the stator, wherein (e) at least two delivery cells, which exhibit a first maximum cell volume form a first delivery cell group, and (f) at least two other delivery cells, which exhibit a second maximum cell volume form a second delivery cell group, wherein (g) the first maximum cell volume of the delivery cells of the first delivery cell group is larger than the second maximum cell volume of the delivery cells of the second delivery cell group, and (h) wherein the first delivery cell group comprises at least two and at most six delivery cells, wherein the adjacent delivery elements of the first delivery cell group are arranged at a first angular distance of 43° from each other on the rotor.

16. The rotary pump according to claim 15, wherein the second delivery cell group comprises at least four and at most ten delivery cells, wherein the adjacent delivery elements of the second delivery cell group are arranged at a second angular distance of 35° to 40° from each other on the rotor.

17. The rotary pump according to claim 15, wherein the rotary pump comprises a total of at least six and at most sixteen delivery cells.

18. A rotary pump comprising:

(a) a stator and (b) a rotor rotatable about a rotational axis within the stator, wherein (c) the rotor comprises multiple delivery elements adapted to move radially in relation to the rotational axis, and (d) two adjacent delivery elements limit a delivery cell together with an outer surface area of a rotor and the inner surface area of the stator, wherein (e) at least two delivery cells which exhibit a first maximum cell volume form a first delivery cell group and (f) at least two other delivery cells which exhibit a second maximum cell volume form a second delivery cell group, wherein (g) the first maximum cell volume of the delivery cells of the first delivery cell group is larger than the second maximum cell volume of the delivery cells of the second delivery cell group, and (h) wherein the second delivery cell group comprises at least four and at most ten delivery cells, wherein the adjacent delivery elements of the second delivery cell group are arranged at a second angular distance of 38.5° from each other on the rotor.

19. The rotary pump according to claim 18, wherein the rotary pump comprises a total of at least six and at most sixteen delivery cells.

20. A rotary pump comprising:

(a) a stator and (b) a rotor rotatable about a rotational axis within the stator, wherein (c) the rotor comprises multiple delivery elements adapted to move radially in relation to the rotational axis, and (d) two adjacent delivery elements limit a delivery cell together with an outer surface area of a rotor and the inner surface area of the stator, wherein (e) at least two delivery cells which exhibit a first maximum cell volume form a first delivery cell group and (f) at least two other delivery cells which exhibit a second maximum cell volume form a second delivery cell group, wherein (g) the first maximum cell volume of the delivery cells of the first delivery cell group is larger than the second maximum cell volume of the delivery cells of the second delivery cell group, and (h) wherein the rotary pump comprises a total of at least six and no more than sixteen delivery cells.

21. The rotary pump according to claim 20, wherein the at least two delivery cells which exhibit the first maximum cell volume and form the first delivery cell group are adjacent delivery cells or the at least two other delivery cells which exhibit the second maximum cell volume and form the second delivery cell group are adjacent delivery cells.

22. The rotary pump according to claim 20, wherein the rotary pump comprises a exactly nine delivery cells.

* * * * *